United States Patent [19]

Biondich

[11] Patent Number: 4,991,735

[45] Date of Patent: Feb. 12, 1991

[54] PRESSURE RESISTANT END SHELL FOR A CONTAINER AND METHOD AND APPARATUS FOR FORMING THE SAME

[75] Inventor: Scott C. Biondich, Delmont, Pa.

[73] Assignee: Aluminum Company of America, Pittsburgh, Pa.

[21] Appl. No.: 348,828

[22] Filed: May 8, 1989

[51] Int. Cl.[5] ..... B65D 51/14; B21D 51/44

[52] U.S. Cl. ..... 220/600; 72/356; 413/8; 413/56

[58] Field of Search ..... 29/401.1; 72/348, 353, 72/356; 413/8, 56; 220/66, 67

[56] References Cited

U.S. PATENT DOCUMENTS

| | | | |
|---|---|---|---|
| 3,417,898 | 12/1968 | Dozek et al. | 220/66 |
| 3,441,170 | 4/1969 | Khoury | 220/54 |
| 3,949,692 | 4/1976 | Deline et al. | 413/13 |
| 4,031,837 | 6/1977 | Jordan | 131/121 |
| 4,055,271 | 10/1977 | Kronenwetter et al. | 220/67 |
| 4,093,102 | 6/1978 | Kraska | 220/67 |
| 4,109,599 | 8/1978 | Schultz | 113/121 |
| 4,280,652 | 7/1981 | Schmidt | 229/43 |
| 4,313,545 | 2/1982 | Maeda | 220/67 |
| 4,467,933 | 8/1984 | Wilkinson et al. | 220/66 |
| 4,559,801 | 12/1985 | Smith et al. | 72/348 |
| 4,571,978 | 2/1986 | Taube et al. | 72/349 |
| 4,641,761 | 2/1987 | Smith et al. | 220/66 |
| 4,704,887 | 11/1987 | Bachmann et al. | 72/347 |
| 4,713,958 | 12/1987 | Bulso, Jr. et al. | 72/348 |
| 4,716,755 | 1/1988 | Bulso, Jr. et al. | 72/349 |
| 4,722,215 | 2/1988 | Taube et al. | 72/349 |
| 4,735,863 | 4/1988 | Bachmann et al. | 428/579 |

*Primary Examiner*—Jimmy G. Foster

*Attorney, Agent, or Firm*—William J. O'Rourke, Jr.; Gary P. Topolosky

[57] ABSTRACT

An end shell for a container, as well as a method and an apparatus for making the same, is provided, comprising a central wall and an annular groove around and below the general plane of the central wall. The annular groove is defined inwardly by a panel wall integrally connected to the central wall and outwardly by a chuckwall which extends upwardly beyond the general plane of the central wall and outwardly therefrom to form an outwardly projecting peripheral flange. The panel wall is disposed at an angle of less than ninety degrees from the general plane of the central wall.

34 Claims, 2 Drawing Sheets

PRESSURE RESISTANT END SHELL FOR A CONTAINER AND METHOD AND APPARATUS FOR FORMING THE SAME

BACKGROUND OF THE INVENTION

The present invention relates to a pressure resistant end shell for a container, as well as to a method and an apparatus for forming such an end shell. More particularly, this invention relates to an end shell for a container formed in such a method, and by an appropriate apparatus, that the end shell has a negative panel wall angle.

The prior art teaches various methods for increasing the pressure resistant capabilities of containers. Increasing the pressure resistance of containers is desirable for various reasons. First, containers having end shells of equivalent gauge can be made to withstand higher internal pressures. And, also, containers having end shells of thinner gauge can be made to withstand equivalent or higher pressures. Being able to reduce the gauge of the material used as end shells for containers, while maintaining adequate internal pressure resistance, has the significant advantage of material cost reduction.

One method of increasing the pressure resistant capabilities of a container is to increase the depth of the annular groove in an end shell, with respect to the central wall of the end shell. U.S. Pat. No. 4,031,837 teaches a method of reforming a conventional end shell by moving a drawing tool into a conventional annular groove while supporting the central wall of the end shell to draw the metal in the process of increasing the depth of the annular groove. U.S. Pat. No. 4,109,599 also teaches a method of forming a pressure resistant end shell for a container in which the thickness of the end shell is not reduced in a final forming operation.

Despite significant progress in the area of increasing the pressure resistant capabilities of end shells for containers, there is still a need and a demand for further improvement.

Accordingly, a new and improved pressure resistant end shell for a container, and a method and an apparatus for forming such an end shell are desired to further increase the pressure holding capabilities.

SUMMARY OF THE INVENTION

This invention may be summarized as providing an end shell for a container comprising a central panel and an annular groove around and below the general plane of the central panel. The annular groove is defined inwardly by a panel wall which is integrally connected to the central panel. The panel wall is disposed at an angle of less than ninety degrees from the general plane of the central panel. The annular groove of the end shell is bounded outwardly by a chuckwall which extends upwardly beyond the general plane of the central panel and outwardly therefrom to form an outwardly projecting peripheral flange.

This invention is also summarized as providing a method for forming the end shell described above. In the method a metal end shell having a central panel and a frustoconical chuckwall extending into an outwardly projecting peripheral flange is formed into an end shell having an annular groove about the central panel. The annular groove is bounded outwardly by the chuckwall and inwardly by a panel wall. In the method of this invention the panel wall is disposed at an angle of less than ninety degrees from the general plane of the central panel.

Among the advantages of this invention is the provision of an end shell for a container, and a method for forming such an end shell, which can be made of thinner than conventional gauge metal and is able to withstand the range of conventional internal container pressures.

Another advantage of the present invention is the provision of a can end which when seamed to a metallic container exhibits increased buckle resistance and improved tab rise characteristics.

A further advantage of the present invention is to provide an end shell for a container, and a method for forming such an end shell, which can be made of certain alloys having lower yield strength and still be able to withstand internal container pressures withstood by certain alloys having higher yield strength.

An objective of this invention is to provide a method for forming an end shell for a container in a reforming operation, including a double or a triple action press, which disposes the panel wall at an angle of less than ninety degrees from the general plane of the central panel of the end shell.

Another objective of this invention is to provide a method for forming a panel wall, having a negative angle, in a can end without resulting in any appreciable thinning of the can end, or the sheet, as a result of the negative angle panel wall forming operation.

A further advantage of this invention is to provide a method to reform the panel wall of a can end without causing appreciable metal exposure and thereby retaining a coating on the can end.

A feature of the present invention is that the cost of generally disc-shaped can ends may be reduced by permitting a reduction in can end gauge without a loss of buckle resistance and other pressure holding capabilities for the can end of this invention.

These and other advantages and objectives of the invention will be more thoroughly understood and appreciated with reference to the following description and the accompanying drawings.

DESCRIPTION OF THE PREFERRED EMBODIMENTS

Although this detailed description focuses upon the present invention as applied to a 206 diameter end shell, the present invention applies to end shells of various size.

Figure 1:
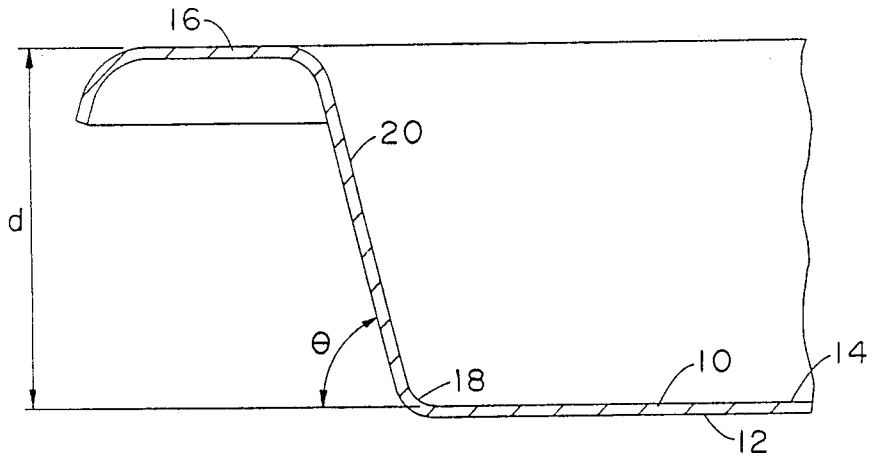
FIG. 1 is an enlarged, fragmentary, cross-sectional view of a generally disc-shaped end shell before reforming into a pressure resistant end shell according to the present invention.

Referring particularly to the drawings, FIG. 1 illustrates a typical sheet metal end shell having an interior surface 12 adapted for exposure to the contents of a container and an exterior surface 14, with respect to the interior and exterior of a container onto which the end shell of this invention is secured. The end shell is typically formed of sheet metal, such as aluminum alloy 5182 in coated, extra hard H-19 temper, blanked from sheet stock at a diameter of about 3.034 inch, and having a gauge within the range of from 0.0085 to 0.012 inch, and preferably about 0.0096 inch. It should be understood that disclosures in this specification of numerical ranges are intended to specifically designate and disclose each number, point and fraction within the scope of the stated range. Materials other than aluminum sheet metal, including steel, tinplate, polymer-aluminum laminates and composite materials, are comprehended by the present invention.

The cut blank may be initially formed into a configuration having a substantially planar central panel portion 10. Extending outwardly and upwardly of the central panel portion 10, from an integral first curved portion 18, is a frustoconical chuckwall 20, which is disposed at a preferred angle $\theta$ of about 70° to 90° relative to the general plane of the central panel 10, and more preferably from about 75° to 83°. A peripheral flange 16 extends outwardly of the outer edge portion of the chuckwall 20. The unit depth d of the end shell shown in FIG. 1 is typically from 0.325 to 0.400 inch, and preferably from 0.355 to 0.375 inch.

The initial configuration for the end shell described above and illustrated in FIG. 1 may be formed in the same press that cuts the blank, as is conventional. This structure, having a peripheral flange 16, provides an end shell which may be readily seated in an aperture in a conveying device, such as a flexible metal or elastomeric conveyor belt, for conveyance to the die or dies, which reform the end shell according to the present invention. It will be understood that forming and reforming operations may be accomplished in a single station or in multiple can end forming stations, or in any number of progressive forming operations, including but not limited to single and multiple action presses or die sets, as such variations are normally matters of mere operational preference.

Figure 2:
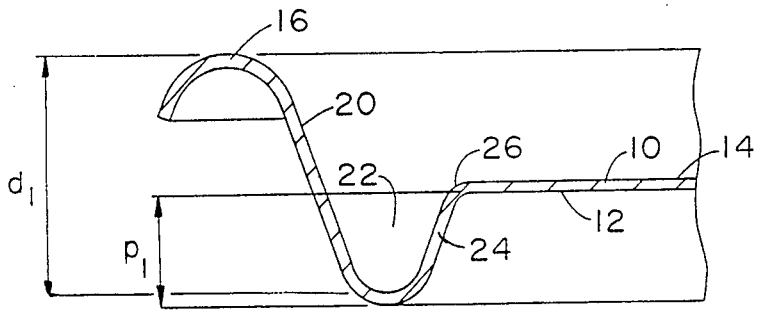
FIG. 2 (PRIOR ART)
FIG. 2 is an enlarged, fragmentary, cross-sectional view of a pressure resistant end shell of the prior art.
Figure 3:
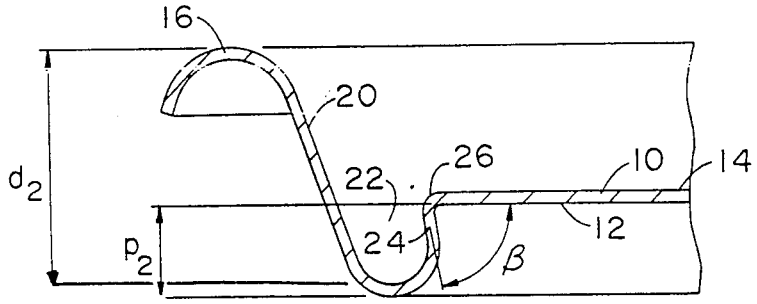
FIG. 3 is an enlarged, fragmentary, cross-sectional view of a pressure resistant end shell of one embodiment of the present invention.

In a preferred embodiment of the present invention, such as that shown in FIG. 3, an end shell is first formed with an annular groove 22 about the periphery of the central panel portion 10. This forming operation may result in a preformed shell, such as the prior art structure illustrated in FIG. 2. Such structure may be accomplished by moving the central panel portion 10 upwardly while restricting substantial deformation of the chuckwall 20 and the peripheral flange 16. Upward movement of the central panel portion 10 reduces the height between the central panel portion 10 and the upper portion of the peripheral flange 16, while causing the metal at the lower portion of the chuckwall 20 to bend or fold upwardly to form an annular groove 22 around the raised central panel portion 10. The annular groove 22 is bounded outwardly, away from the central panel 10, by the chuckwall portion 20 and inwardly, toward the central panel 10, by a panel wall portion 24. The panel wall 24 is integrally connected to the central panel 10, typically through a second curved portion 26.

In a preferred embodiment, an initially formed end shell, such as that shown in FIG. 2, is subjected to a subsequent reforming operation. In the reforming operation the panel wall portion 24 is moved toward the chuckwall portion 20 such that the panel wall portion 24 is disposed at an angle $\beta$ of less than ninety degrees from the general plane of the central panel portion 10. This angle of less than ninety degrees from the general plane of the central panel portion 10 is sometimes referred to as a negative panel wall angle. The negative panel wall angle is sometimes called an acute angle. In a preferred embodiment the negative panel wall angle $\beta$ is from about 70° to 88°, and in a more preferred embodiment the negative panel wall angle $\beta$ is from about 75° to 86°. However, it should be appreciated that negative panel wall angles substantially less than about 90°, and even less than about 60°, are encompassed within the scope of this invention. In one particular embodiment of this invention, a negative panel wall angle $\beta$ of about 79° is found to exhibit particularly favorable results.

In the reforming operation described above, a conventional end shell prior to reforming, such as that shown in FIG. 2, may have a panel depth $p_1$ from the bottom of the central panel portion 10 to the bottom of the annular groove 22 of about 0.090 to 0.092 inch. After reforming to provide the negative panel wall angle $\beta$, the panel depth is typically reduced, such as to a depth $p_2$ of about 0.078 to 0.080 inch. Note that it is preferred that the unit depth $d_1$ before the reforming operation remains unchanged after the reforming operation. A preferred unit depth $d_1$ and $d_2$ for end shells of this invention is from about 0.250 to 0.270 inch. It is also preferred that the diameter of the preformed end shell, such as is measured at the base of the annular groove, remains unchanged, such as 2.11 inch after the reforming operation.

It is also desirable that substantially no thinning of the gauge of the metal in the end shell result in the formation of the end shell with a negative panel wall angle in accordance with the present invention. It is recognized that some metal thinning may occur, and may even be desirable, in performing operations on a can end other than the formation of the negative panel wall angle $\beta$. It is also recognized that preventing thinning of the end shell during the formation of the negative panel wall angle $\beta$ is a preferred embodiment.

In a preferred embodiment of this invention the panel wall thickens during formation of the negative panel wall angle $\beta$. In this embodiment, the material in the panel wall is put into compression. While in compression, the panel wall is moved to form the negative panel wall angle. Such compression during material movement may result in thickening of the panel wall, usually on the order of less than about ten percent (10%), and perhaps only about two to three percent (2–3%). Thickening of the panel wall is beneficial in that the pressure holding and buckle resistant capabilities of the end shell are further increased. It will be appreciated by those skilled in the art that, if desired, the forming tools may be modified to increase the compression in the panel wall, and thereby increase the thickening of the panel wall.

In another preferred embodiment, the gauge of the end shell about the annular groove is uniform, i.e., holds a tolerance of plus or minus 0.0005 inch. Therefore, in the process of the present invention, it is preferred that metal thinning be prevented, end shell diameters be maintained, and panel depth be reduced from that of conventional end shells. Depending upon the reduction in the panel depth from $p_1$ in FIG. 2 to $p_2$ in FIG. 3, if any, the initial blank diameter may have to be increased slightly in order to maintain the finished end shell dimensions after forming the negative panel wall angle $\beta$. In one preferred embodiment, it has been found that increasing the shell blank diameter from 3.034 inch to 3.048 inch provides sufficient metal to maintain the end shell diameter after forming the negative panel wall angle $\beta$ according to the present invention. As will be explained in more detail below, even though the initial blank may have to be slightly larger in diameter than normal, the present invention permits gauge reduction which more than offsets the metal increase attributed to the slight increase in the diameter of the blank, or the longitudinal extent of the formed end shell, and overall results in a reduction in the total amount of metal required to form a pressure resistant end shell.

In the forming of the end shell of the present invention, the first general operation is the blanking operation wherein circular blanks are typically cut or punched from continuous coils of sheet metal. The blanks are drawn into a generally cup-shaped body, without tearing or otherwise damaging the blank. The peripheral portions of the cup-shaped body are formed into an outwardly projecting and downturned peripheral flange as generally shown in FIG. 1. Further curling of the peripheral flange may occur at this stage of the operation.

The second general operation is the formation of an annular groove 22 about the periphery of the central panel portion 10. This is typically accomplished by disposing the surface of one die against the interior surface 12 of the central panel portion 10, and the surface of another die against the exterior surface 14 and around the periphery of the peripheral flange 16, and moving the dies to put the end shell into compression. It is understood that either one or both dies may move in the formation of the annular groove 22. Further movement of the dies toward one another raises the central panel portion 10 with respect to its disposition at the bottom of the chuckwall portion 20, as illustrated in FIG. 1, and bends or folds the metal toward the bottom of the chuckwall portion 20 to form the annular groove 22 around the central panel portion 10. The annular groove 22 is bounded on the outside by the chuckwall portion 20 and on the inside by the panel wall portion 24, such as that shown in FIG. 2. This second general operation is also generally known in the art, such as is disclosed in U.S. Pat. Nos. 4,109,599 and 4,031,837, which are incorporated herein by reference.

Figure 4:
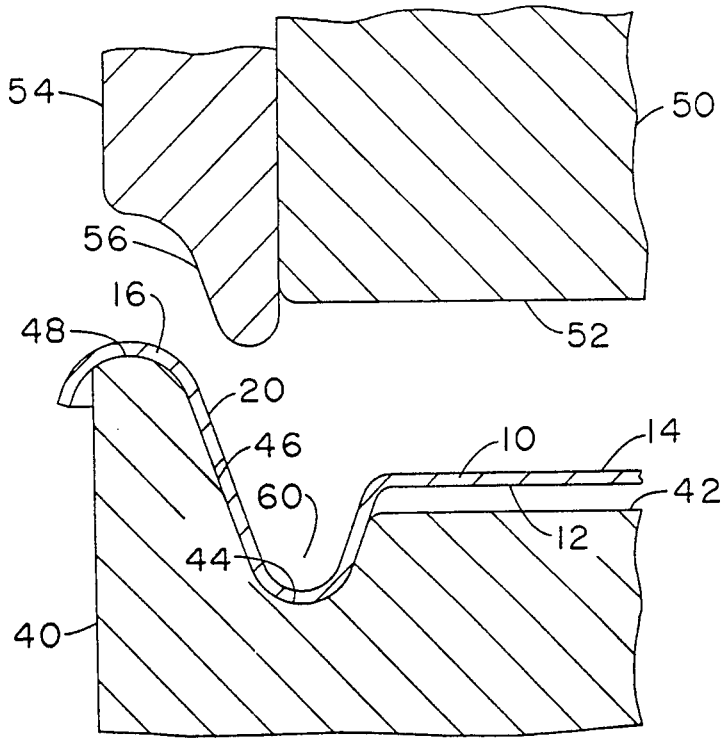
FIG. 4 is an enlarged, fragmentary, cross-sectional view through dies used for forming an end shell such as the end shell shown in FIG. 3, in accordance with the present invention, with the dies shown in an open position.
Figure 5:
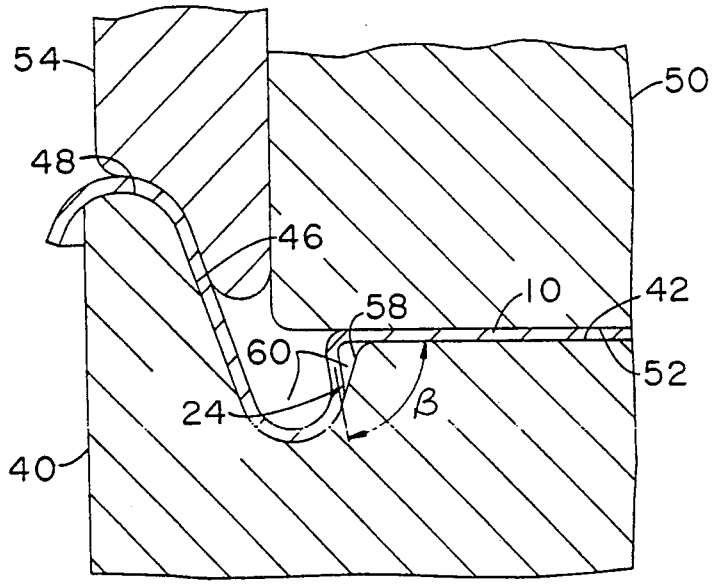
FIG. 5 is an enlarged, fragmentary, cross-sectional view through dies used for forming an end shell such as the end shell shown in FIG. 3, in accordance with the present invention, with the dies shown in a closed position.

FIGS. 4 and 5 illustrate representative tools which may be employed to form the pressure resistant end shell for a container which is a subject of this invention. The lower dies include a locating ring 40, having a generally planar top surface 42. It will be appreciated that top surface 42 may have non-planar configuration portions corresponding to nonplanar portions on the end shell to be reformed within such tools. Surrounding the top surface 42 of the locating ring 40 is an annular ring 44 shaped to receive the annular groove 22 of the end shell. The depth of the ring 44 is such that when the annular groove 22 of the end shell, prior to reforming, is disposed therein, the bottom surface 12 of the central wall portion 10 of the end shell is disposed away from the top surface 42 of the locating ring 40, as illustrated in FIG. 4. The annular ring 44 of the locating ring 40 extends upwardly and outwardly along die surface 46 in a profile that corresponds substantially with the profile of the chuckwall 20 of the can end to be reformed. Die surface 46 extends upwardly to top die surface 48 which substantially mates with or conforms to the interior surface 12 of the peripheral flange 16 of the end shell to be reformed. Although the locating ring 40 is shown as a single unit, it will be appreciated that multipiece dies may be employed.

The upper dies include a central punch 50 having a substantially planar, circular outside surface 52. The outside diameter of the outside surface 52 is greater than the outside diameter of the central wall portion 10 of the can end to be reformed. Thus, the outside diameter of outside surface 52 is necessarily greater than the diameter of the top surface 42 of the locating ring 40. Surrounding the punch 50 is a clamping ring 54 having a bottom clamping surface 56 which substantially mates with or conforms to the exterior surface 14 of the end shell to be reformed, at a portion of the peripheral flange 16 and along an upper portion of the chuckwall 20 of the end shell. As will be appreciated from the discussion of the operation of the tools, the upper dies shall not restrict movement of the panel wall 24 in forming the negative panel wall angle of this invention.

In the operation of the dies from an open position shown in FIG. 4 to a closed position shown in FIG. 5, the end shell is inserted between the dies by apparatus and methods which are well known in the art. FIG. 4 shows the end shell sitting upon the locating ring 40. It will be appreciated that the end shell could sit on the clamping surface 56 of the clamping ring 54 if the dies were inverted.

With the can end seated between the dies, the clamping ring 54 is moved toward the locating ring 40. At least a portion of the peripheral flange 16 and an upper portion of the chuckwall of the can end is clamped and held between outside surfaces 46 and 48 of the locating ring 40 and the bottom clamping surface 56 of the clamping ring 54. With the peripheral portion of the end shell so clamped, the outside surface 52 of the central punch 50 is moved against the exterior surface 14 of the central wall portion 10 of the can end. Continued movement of the central punch 50 toward the top surface 42 of the locating ring 40 disposes the central wall portion 10 toward and against the top surface 42 of the locating ring 40. Such movement of the central wall portion 10 reduces the panel depth p of the end shell, while maintaining the unit depth of the end shell. This results in the outward disposition of the panel wall 24, as the panel wall 24, particularly the upper portion of the panel wall 24, is disposed outwardly away from an inside wall 58 in the annular ring 44 of the locating ring 40, to form a negative angle panel wall. It is important that no tools be disposed outwardly of the panel wall 24 in any manner that may interfere with the outward disposition of the panel wall 24. Rather, a recess such as the recess shown in area 60, illustrated in FIGS. 4 and 5, should be provided and maintained in the annular ring 44 area where the panel wall 24 may freely bend or fold into its negative panel wall angle.

The amount of negative angle $\beta$ for the panel wall 24 may be controlled by determining the height of the inside wall 58 in the annular ring. Such height should conform to the desired reformed panel depth $p_2$. Another method of controlling the amount of negative angle $\beta$ for the panel wall 24 is to control the extent of movement of the punch 50 against the central wall portion 10 of the can end.

The end shell of the present invention is seamed to the end of a mating hollow, cylindrical can body, such as an aluminum alloy drawn and ironed container. Conventional double seaming may be performed without a loss of double seam integrity. When seamed to a cylindrical can body, an end shell of the present invention, having a negative panel wall angle $\beta$, exhibits increased pressure resistance over end shells of the same alloy and gauge, not having a negative panel wall angle. To illustrate the increased pressure resistance, end shells of 5182 aluminum alloy having 0.0096 inch gauge with a 0.260 inch unit depth and 0.079 inch panel depth having a conventional panel wall without a negative panel wall angle having a panel wall angle of 90°, were pressure tested in comparison to end shells of 5182 aluminum alloy having 0.0096 inch gauge, with a 0.260 inch unit depth and 0.079 inch panel depth with a negative panel wall angle of 79°. The comparison was based on buckle resistance, i.e., the pressure at which the end shell will deform (buckle) outwardly of a cylindrical container onto which the end is seamed. When these two different end shells, having the same 0.079 inch panel depth were compared, the shell of the present invention exhibited an increased buckle resistance of 6 psig, or 6.6% better than that of the standard end shell. This increased buckle performance for the end shell of the present invention, though not comparing better than the standard end shell in every instance, was statistically better than the standard end shell at a 95% confidence level.

A computer model designed to evaluate the improved buckle resistance of can ends predicts that an end shell of the present invention with a 0.090 inch panel depth would exhibit a 6.8% increase in buckle resistance over a conventional can end, of like alloy, temper and gauge, having a panel depth of 0.090 inch. For this comparison, the predicted cut edge diameter for a preferred shell design of the present invention is 3.033 inch compared to a 3.019 inch cut edge diameter for the conventional can end. These model results indicate that the gauge of the can end of the present invention could be reduced by 0.0006 inch, thus saving about $0.20 per 1,000 end shells manufactured at current material costs.

What is believed to be the best mode of this invention has been described above. It will be apparent to those skilled in the art that numerous variations of the illustrated and described details may be made without departing from the scope of this invention. For example, the preferred embodiments describe forming the negative panel wall angle $\beta$ in multiple forming tools. However, it will be appreciated that blanking, curling of the flange, and formation of the annular groove could occur in single multi-action press or in a plurality of single or multi-action presses. Also, the negative panel wall angle $\beta$ could be formed directly as opposed to having an intermediate operation that defines an annular groove; or alternatively, the negative panel wall angle $\beta$ could be formed in a number of progressive stages. These and other alternative embodiments are fully comprehended by the present invention.

I claim:

1. An end shell for a container having improved internal pressure resistance comprising:

a central panel portion, an open annular groove around and below the general plane of the central panel portion, said open annular groove bounded outwardly by a chuckwall portion extending upwardly and outwardly from the annular groove beyond the general plane of the central panel portion, said annular groove bounded inwardly with respect to the central panel, by a panel wall portion integrally connected to the central panel portion, said panel wall disposed at an angle of less than 90° and greater than or equal to 70° from the general plane of the central panel portion, and at an angle greater than or equal to the angle formed by the chuckwall relative to the general plane of the central panel portion, and an outwardly projecting flange, extending radially outwardly of the upwardly extending chuckwall portion.

2. An end shell as set forth in claim 1 wherein the end shell is an aluminum alloy.

3. An end shell as set forth in claim 1 wherein the end shell is a steel alloy.

4. An end shell as set forth in claim 1 wherein the end shell is a polymer-aluminum laminate.

5. An end shell as set forth in claim 1 wherein the gauge of the end shell about the annular groove is uniform within a 0 to 0.0005 inch tolerance.

6. An end shell as set forth in claim 5 wherein the gauge of the end shell is from 0.0085 to 0.012 inch.

7. An end shell as set forth in claim 1 wherein the panel wall portion is disposed at an angle of less than about 88° from the general plane of the central panel portion.

8. An end shell as set forth in claim 1 wherein the panel wall portion is disposed at an angle of less than about 86° from the general plane of the central panel portion.

9. An end shell as set forth in claim 1 wherein the panel wall portion is disposed at an angle of from about 75° to 86° from the general plane of the central panel portion.

10. An end shell as set forth in claim 1 wherein the panel wall portion is substantially parallel to the chuckwall portion.

11. An end shell as set forth in claim 1 wherein depth of the panel from the bottom of the central panel portion to the bottom of the annular groove is about 0.060 to 0.090 inch.

12. An end shell as set forth in claim 1 wherein depth of the panel from the bottom of the central panel portion to the bottom of the annular groove is from about 0.070 to 0.080 inch.

13. An end shell as set forth in claim 1 wherein a blank diameter of the end shell is about 2.980 to 3.065 inch.

14. An end shell as set forth in claim 1 wherein depth of the end shell from the top of the peripheral flange to the top of the annular groove is about 0.250 to 0.270 inch.

15. An end shell as set forth in claim 1 wherein the diameter of the end shell as measured at the bottom of the annular groove is about 2.11 inch.

16. A method of forming a pressure resistant end shell for a container comprising the steps of:

providing an end shell having an interior surface and an exterior surface with respect to the intended disposition of the end shell onto the container, a central panel portion in the end shell, a frustoconical chuckwall portion projecting outwardly and upwardly beyond a general plane of the central panel portion at an angle of from 70° to 90° with respect to the central panel portion, and an outwardly projecting flange extending radially outwardly of the chuckwall portion, and while substantially retaining the angular disposition of the chuckwall with respect to the central panel portion, moving a part of the central panel portion to form an annular groove about the central panel portion bounded outward, with respect to the central panel, by the chuckwall portion extending from the annular groove upwardly beyond the general plane of the central panel portion, and bounded inwardly, with respect to the central panel, by a panel wall portion disposed at an angle of less than 90° and greater than or equal to 70° from the general plane of the central panel portion, and said panel wall portion being disposed at an angle greater than or equal to the angle of the chuckwall portion with respect to the central panel portion.

17. A method as set forth in claim 16 wherein the moving of the central panel portion to form the annular groove is conducted in a plurality of steps, the first step of which forms an annular groove bounded on the inside by the panel wall portion disposed at an angle equal to or greater than 90° from the general plane of the central panel portion, and the last step of which disposes the panel wall portion at said angle of less than 90° from the general plane of the central panel portion.

18. A method as set forth in claim 17 wherein the gauge of the end shell about the annular groove remains substantially the same after the first step to the last step.

19. A method as set forth in claim 18 wherein the gauge is uniform with up to about 0.0005 inch tolerance.

20. A method as set forth in claim 18 wherein the gauge is from 0.0085 to 0.0105 inch.

21. A method as set forth in claim 17 wherein the diameter of the end shell as measured at the bottom of the annular groove at the end of the first step is substantially the same diameter of the end shell as measured at the bottom of the annular groove at the end of the last step.

22. A method as set forth in claim 17 wherein at least one intermediate step is provided between the first step and the last step wherein the panel wall is disposed outwardly toward the chuckwall to form a panel wall angle with the general plane of the central panel portion which is less than the panel wall angle formed in the first step and greater than the panel wall angle formed in the last step.

23. A method as set forth in claim 16 wherein the end shell is an aluminum alloy.

24. A method as set forth in claim 16 wherein the end shell is a steel alloy.

25. A method as set forth in claim 16 wherein the end shell is a polymer-aluminum laminate.

26. A method as set forth in claim 16 wherein the panel wall portion is disposed at an angle of less than 88° from the general plane of the central panel portion.

27. A method as set forth in claim 16 wherein the panel wall portion is disposed at an angle of less than 86° from the general plane of the central panel portion.

28. A method as set forth in claim 16 wherein the panel wall portion is disposed at an angle of from 75° to 86° from the general plane of the central panel portion.

29. A method as set forth in claim 16 wherein the sheet metal end shell has a transverse dimension of about 2.980 to 3.065 inch.

30. A method as set forth in claim 16 wherein the depth of the end shell from the top of the peripheral flange to the bottom of the annular groove is about 0.250 to 0.270 inch.

31. A method as set forth in claim 16 wherein the diameter of the end shell as measured at the bottom of the annular groove is about 2.11 inch.

32. A method of forming a pressure resistant end shell for a container comprising the steps of:

providing an end shell having an interior surface and an exterior surface with respect to the intended disposition of the end shell onto the container, a central panel portion in the end shell, a frustoconical chuckwall portion projecting outwardly and upwardly with respect to the central panel portion, and an outwardly projecting flange extending radially outwardly of the chuckwall portion, and moving, in a plurality of steps, a part of the central panel portion to form an annular groove about the central panel portion bounded outward, with respect to the central panel, by the chuckwall portion extending from the annular groove upwardly beyond the general plane of the central panel portion, and bounded inwardly, with respect to the central panel, by a panel wall portion disposed at an angle of less than 90° from the general plane of the central panel portion, the first step of which forms an annular groove bounded on the inside by a panel wall portion disposed at an angle equal to or greater than 90° from the general plane of the central panel portion, and the last annular groove forming step of which disposes the panel wall portion at an angle of less than 90° from the general plane of the central panel portion wherein the gauge of the end shell about the panel wall is thickened between the first and the last annular groove forming step.

33. A method of forming a pressure resistant end shell for a container comprising the steps of:

providing an end shell having an interior surface and an exterior surface with respect to the intended disposition of the end shell onto the container, a central panel portion in the end shell, a frustoconical chuckwall portion projecting outwardly and upwardly with respect to the central panel portion, and an outwardly projecting flange extending radially outwardly of the chuckwall portion, and moving, in a plurality of steps, a part of the central panel portion to form an annular groove about the central panel portion bounded outward, with respect to the central panel, by the chuckwall portion extending from the annular groove upwardly beyond the general plane of the central panel portion, and bounded inwardly, with respect to the central panel, by a panel wall portion disposed at an angle of less than 90° from the general plane of the central panel portion, the first step of which forms an annular groove bounded on the inside by a panel wall portion disposed at an angle equal to or greater than 90° from the general plane of the central panel portion, and the last annular groove forming step of which disposes the panel wall portion at an angle of less than 90° from the general plane of the central panel portion wherein the depth of the end shell measured from the top of the outwardly projecting flange to the top of the annular groove is held constant after the first step by inserting a tool into and against the outer peripheral portion of the annular groove during subsequent steps.

34. An apparatus for forming a pressure resistant end shell for a container comprising:

a first die set including a generally planar top surface, an annular ring surrounding said top surface and recessed below said top surface at a depth less than the distance between an inside surface of a central wall and an outside surface of an annular groove of the end shell, and an upstanding portion extending outwardly and upwardly from the annular ring, said upstanding portion having a configuration mating substantially with a configuration of the annular groove, chuckwall and at least a portion of a peripheral flange of the end shell, a second die set, generally opposing the first die set, including a central punch having a circular outside surface with a diameter greater than the diameter of the top surface of the first die set, and a clamping ring having an outside clamping surface having a configuration mating substantially with a configuration of at least a portion of the exterior surface of the peripheral flange and at least an upper portion of the exterior surface of the chuckwall, means for inserting an end shell between the first die set and the second die set, means for moving the clamping ring of the second die set toward the upstanding portion of the first die set to clamp at least a portion of the peripheral flange and at least an upper portion of the chuckwall of the end shell therebetween, means for moving the central punch against the exterior surface of the central wall of the end shell, after the peripheral flange and chuckwall portions have been clamped, to move a panel wall of the end shell outwardly into a recess in the apparatus to dispose the panel wall at an angle of less than 90° from the general plane of the central wall, means for opening the dies, and means for removing the end shell.

* * * * *